US007726365B2

(12) United States Patent
Hu

(10) Patent No.: US 7,726,365 B2
(45) Date of Patent: Jun. 1, 2010

(54) ELECTRIC PENCIL SHARPENER

(75) Inventor: Jingyi Hu, Shenzhen (CN)

(73) Assignee: Ringsun (Shenzhen) Industrial Limited, Shenzhen, Guangdong Province (CN)

( * ) Notice: Subject to any disclaimer, the term of this patent is extended or adjusted under 35 U.S.C. 154(b) by 340 days.

(21) Appl. No.: 11/819,986

(22) Filed: Jun. 29, 2007

(65) Prior Publication Data

US 2009/0000695 A1 Jan. 1, 2009

(51) Int. Cl.
*B43L 23/00* (2006.01)

(52) U.S. Cl. ..... 144/28.72; 144/28.7

(58) Field of Classification Search ..... 144/28.1–28.72
See application file for complete search history.

(56) References Cited

U.S. PATENT DOCUMENTS 3,746,061 A * 7/1973 Nakazaki ..... 144/28.5
4,966,208 A * 10/1990 Uang ..... 144/28.72
6,886,614 B2 * 5/2005 Ricono et al. ..... 144/28.11

* cited by examiner

*Primary Examiner*—Shelley Self
(74) *Attorney, Agent, or Firm*—Jacobson Holman PLLC

(57) ABSTRACT

An electric pencil sharpener includes a motor, a transmission subassembly and a cutter subassembly driven by the motor, a feeding subassembly and at least one resilient adjusting means. The feeding subassembly includes a feeding gear set coupled to the transmission subassembly and two feeding rollers adapted to sandwich a pencil to be sharpened, at least one feeding roller is driven by the feeding gear set. The pair of brackets is arranged in parallel, respectively defining slide ways to movablely support the feeding rollers. A feeding space is defined between the two brackets. The at least one resilient adjusting means connects the two feeding rollers outside or inside the feeding space, adapted for keeping the feeding rollers nipping the pencil and engendering a pencil feeding friction.

8 Claims, 4 Drawing Sheets

ELECTRIC PENCIL SHARPENER

BACKGROUND OF THE INVENTION

1. Field of the Invention

The present invention generally relates to an office product, electric pencil sharpener, more particularly the present invention relates to an improved electric pencil sharpener provided with a feeding subassembly with a pair of feeding rollers, which space between the two feeding rollers is automatically adjustable. A further novel element of the invention is the provision for an electric pencil sharpener capable of automatic sharpening and feeding different pencils with different sizes.

2. Background of the Invention

Pencil sharpener is a necessary tool in the modern office. Electric pencil sharpeners are in widespread use largely due to their modest price and outstanding reliability. A typical electric pencil sharpeners comprises an electric motor, a gear train, a cutter assembly, and a receptacle receiving a pencil or a pencil alignment subassembly, and a switch for activating the motor, e.g. upon insertion of a pencil. When the pencil is positioned in the receptacle, the motor exports its power to the cutter assembly through the gear train. The pencil is sharpened by a blade of the cutter assembly. Numerous innovations for pencil sharpeners have been provided in the prior art that will be described.

A typical pencil sharpener is presented, in cross reference to applicant's related application, U.S. application Ser. No. 11/602,252, filed on the date Nov. 21, 2006, which teaches an improved electric pencil sharpener. The aforementioned improved electric pencil sharpener includes a motor, a transmission subassembly engaged with the motor, a cutter subassembly and a feeding subassembly and an enclosure holding all the components. The cutter assembly and the feeding subassembly are driven by the transmission subassembly. Said feeding subassembly includes a feeding gear set and a pair of feeding rollers driven by the feeding gear set. The interval between the two feeding rollers is adjusted under an adjusting subassembly with complicated structure. The adjusting subassembly includes a cage forming an inner path thereinside, a cap covering one end portion of the cage, a pair of bracket standing on the enclosure defining an interior space, and two adjusting block arranged on respective brackets. The cage encompasses the brackets and the interior space. Each of the feeding rollers is fixed a shaft supported between the two brackets and getting through slide ways defined in each of the brackets. The adjusting blocks are respectively attached to the two axes carrying feeding rollers at the point where the axes sticking out the interior space from the brackets. Each of the adjusting blocks combines an adjusting rod. A spring is squeezed between the cap and the adjusting rods so as to urge the adjusting rods to ride along the path inside the cage in close proximity. When sharpening pencils with different diameter, rotate the cap, the adjusting rods ride along the path to push the axes carrying feeding rollers moving back or forth, thereby changing the interval between the two feeding rollers under restriction of the slide ways in the pair of brackets. However, the adjusting assembly in the conventional electric pencil sharpener is so sophisticated, that results in high manufacturing cost. Moreover, the interval adjustment between the two feeding rollers is under manual operation, which is inconvenient for people to operate such electric pencil sharpener.

In light of the foregoing, there is a very desirable need to improve the typical electric pencil sharpener.

BRIEF SUMMARY OF THE INVENTION

In general, the systems and methods of the invention have several features, no single one of which is solely responsible for its desirable attributes. Without limiting the scope of the invention as expressed by the claims which follow, its more prominent features will now be discussed briefly. After considering this discussion, and particularly after reading the section entitled "Detailed Description of Certain Embodiments" one will understand how the features of the system and methods provide several advantages over traditional electric pencil sharpeners.

In one aspect of the present invention, an improved electric pencil sharpener is provided includes a motor, a transmission subassembly driven by the motor, a cutter subassembly driven by the transmission subassembly, a feeding subassembly driven by the cutter subassembly and at least one resilient adjusting means. The feeding subassembly includes a pair of feeding rollers movablely supported on two brackets arranged in parallel position, defining a feeding space therebetween. The at least one resilient means connects the two feeding rollers and is capable of automatically adjusting the interval between the two feeding rollers so as to conveniently sharpen pencils with different diameter.

In another aspect of the present invention, an improved electric pencil sharpener is disclosed engaging one resilient adjusting means, connecting the two feeding rollers outside or inside the feeding space.

In still another aspect of the present invention, an improved electric pencil sharpener is disclosed engaging two resilient adjusting means, respectively connecting the two feeding shaft on two sides thereof outside or inside the feeding space.

In further aspect of the present invention, an improved electric pencil sharpener is disclosed combining a motor, a transmission subassembly driven by the motor, a cutter subassembly driven by the transmission subassembly, a feeding subassembly driven by the cutter subassembly, at least one resilient adjusting means and an electric controlling system. The electric controlling system includes a startup switch, triggering means and reverse switch under control of the triggering means for driving the motor to rotate in a reverse direction, so that render the electric pencil sharpener capable of self-feeding while sharpening the pencil and self-retreating after the pencil is processed.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF CERTAIN EMBODIMENTS

Figure 1:
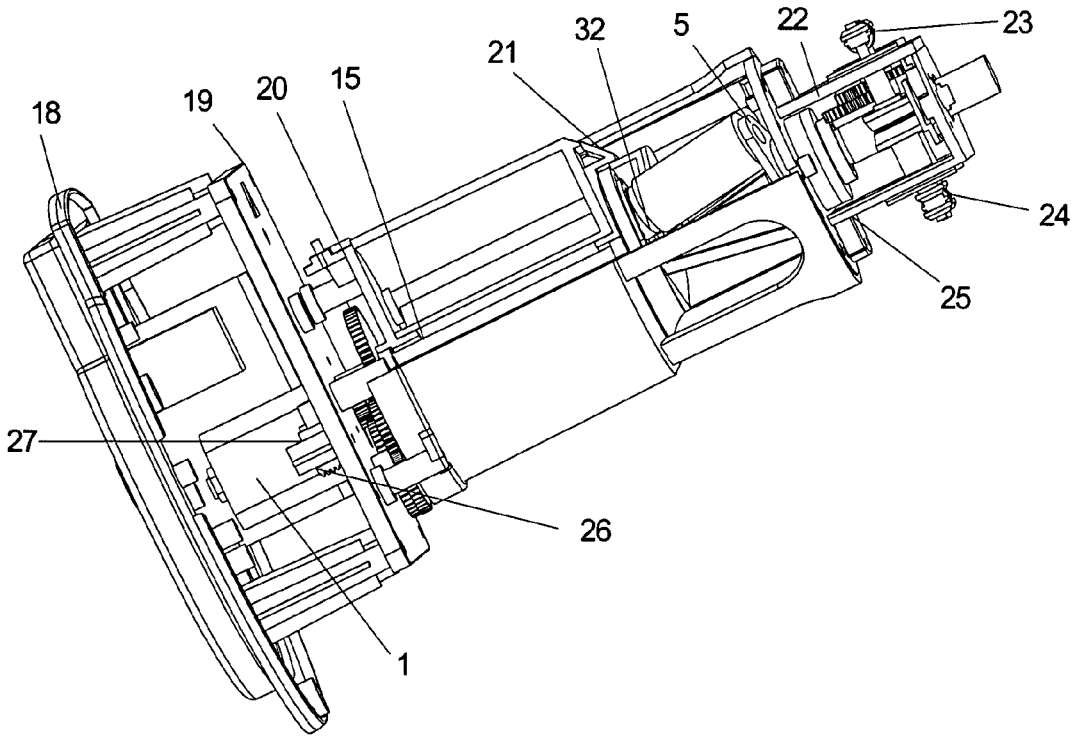
FIG. 1 is a perspective view of an electric pencil sharpener assembly in accordance with an embodiment of the present invention and shows a motor, a transmission subassembly, a cutter subassembly, a feeding subassembly and a resilient adjusting member.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

Accordingly, an object of the present invention is to provide an electric pencil sharpener with improved feeding and adjusting configuration to automatically adjust the interval between two feeding rollers so as to conveniently sharpen pencils with different diameter. Another object of the present invention is to provide an electric pencil sharpener combining an electric controlling system, capable of self-feeding while sharpening the pencil and self-retreating after the pencil is processed.

To achieve the above objects and in accordance with the purpose of the embodiments of the invention as embodied and broadly described herein, an embodiment of an electric pencil sharpener includes a chassis, a powering subassembly, i.e., a motor 1, a cutter subassembly and a feeding subassembly powered by the motor 1, an electric control system, and a resilient adjusting means. The feeding subassembly is driven by the transmission subassembly through a feeding gear set.

Referring to FIG. 1, the chassis includes a base 18 supporting a cage 19, and a cage cover 20. The cage 19 receives the motor 1 and the transmission subassembly. A holding frame 21 for fixing the cutter subassembly is fixed upon the cage cover 20. A first and second bracket 22, 25 are arranged on the top of the holding frame 21 in parallel position, thereby defining a feeding space between the first bracket 22 and the second bracket 25. Each of the brackets 22, 25 define symmetric slide ways 222. The symmetric slide ways 222 in both brackets 22, 25 define an arc-shaped locomotive track for the feeding subassembly.

The feeding gear set includes a cluster gear 13, a second feeding gear 8 and a crown gear 6.

Figure 2:
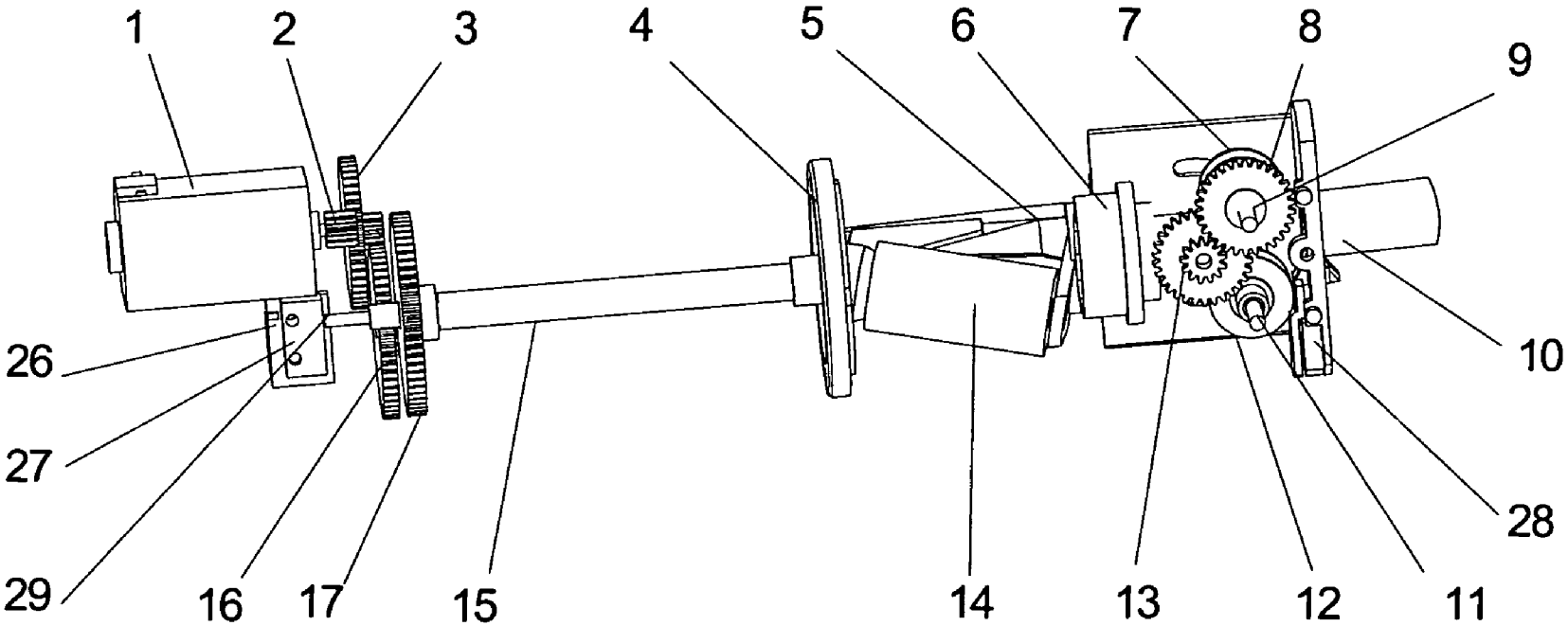
FIG. 2 is a perspective view of the transmission subassembly of the electric pencil sharpener of the preferred embodiment in FIG. 1.
Figure 3:
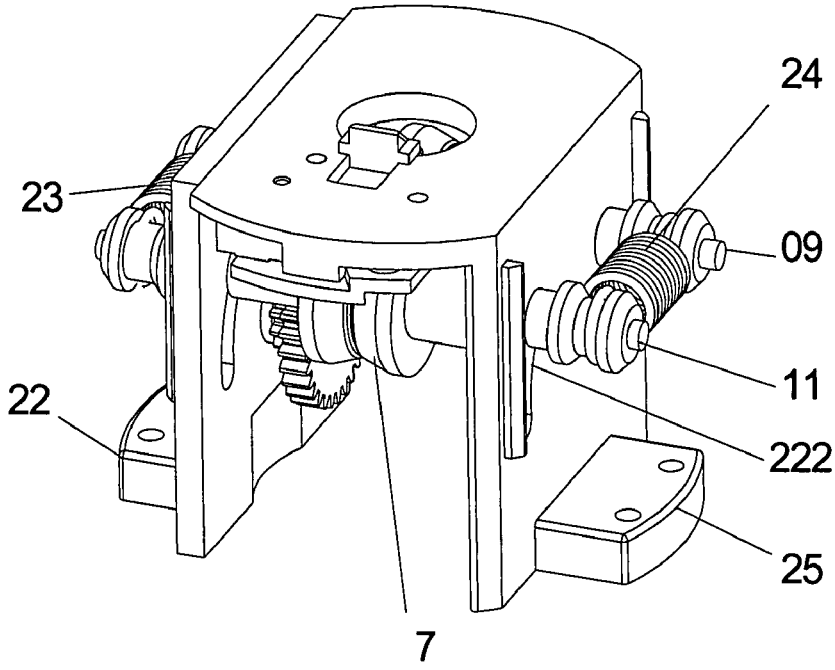
FIG. 3 is a schematic view of the feeding subassembly in FIG. 1.
Figure 4:
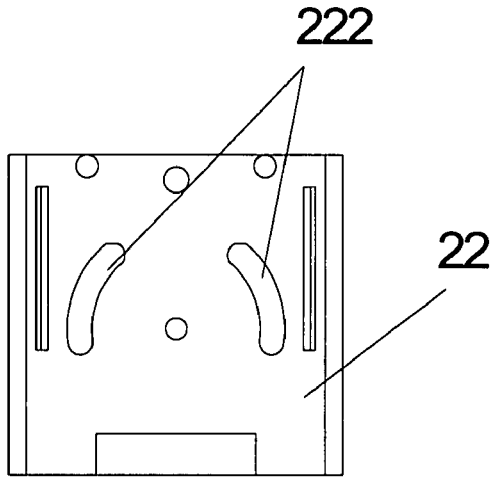
FIG. 4 is a schematic view of a bracket of the feeding subassembly according to an embodiment of the invention.

Referring to FIG. 1 and FIG. 2, the transmission subassembly includes a gear train, a transmission shaft 15, and a blade holder 5. The gear train includes motor pinion 2, a second gear 3, a third gear 16 and a fourth gear 17, which are successively meshes with adjacent ones. The second gear 3 and the motor pinion 2 are in mesh. The subassembly shaft 15, the blade holder 5, and the crown gear 6 are successively connected with one another, and capable of pivoting along with the third gear 16. The crown gear 6 defines a through hole (not shown), and the through hole is configured as a pencil inlet to the sharpening chamber of the cutter subassembly. During sharpening a pencil, the motor 1 drives the gear train, and the transmission shaft 15 rotating therealong. The blade holder 5 is attached to the transmission shaft 15, therefore the blade holder 5 rotates at the same time. The crown gear 6 is engaged with the blade holder 5, and rotating along with the blade holder 5 simultaneously. The crown gear 6 meshes with the cluster gear 13, and the cluster gear 13 meshes with the second feeding gear 8. The second feeding gear 8 is mounted on one feeding shaft. In the preferred embodiment, the second feeding gear 8 is mounted on the feeding shaft 9. So, the feeding shaft 9 is an active feeding shaft and another feeding shaft 11 is a follower feeding shaft.

Figure 5:
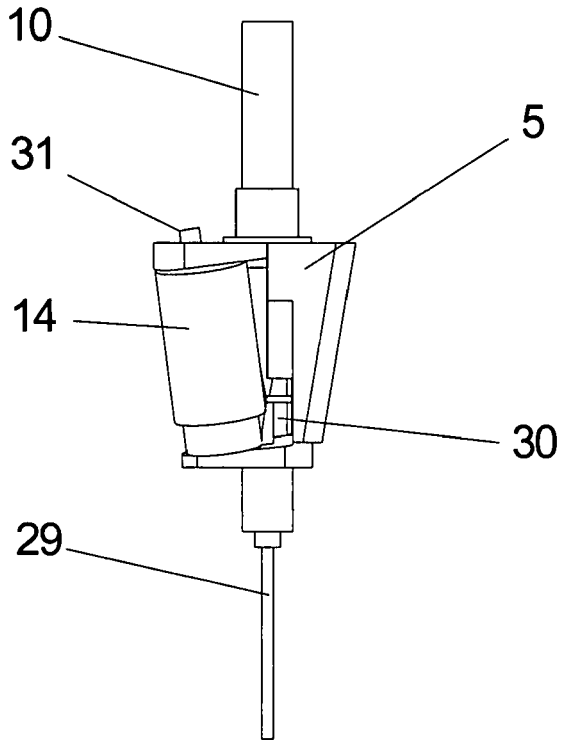
FIG. 5 is a perspective view of the cutter subassembly illustrated in FIG. 1.

Referring to FIG. 5, the cutter subassembly include a blade set and the blade holder 5. An annular gear 4 is attached to the holding frame 21 of the chassis. The blade set includes a helical blade 14, a blade pinion 32 and a blade shaft 31 engaged with blade holder 5. The helical blade 14 is supported on the blade shaft 31, and the blade pinion 32 is attached to the blade 14 at the bottom portion. The blade pinion 32 and the annular gear 4 are in mesh. When the helical blade 14 revolves along with the blade support 5, rotation of the helical blade 14 causes blade pinion 32 to travel around the annular gear 4, thereby causing the helical blade 14 to rotate on blade shaft 31 and sharpen the pencil.

The feeding subassembly is configured to feed the pencil, comprising a first feeding shaft 9, a second feeding shaft 11, a first feeding roller 7, a second feeding roller 12 and a feeding gear set engaged with one of the feeding shafts 9,11. In the present embodiment, the second feeding gear 8 of the feeding gear set is mounted on the first feeding shaft 9 carrying the active feeding roller 7. The first feeding roller 7 is mounted on the first feeding shaft 9, and the second feeding roller 12 is mounted on the second feeding shaft 11. The feeding rollers 7, 12 together with the first and second feeding shafts 9, 11 are respectively supported on the face to face brackets 22, 25 through corresponding guide ways 222, leaving the feeding rollers 7, 12 in the feeding space between the brackets 22, 25. In the present embodiment, the feeding shafts 9, 11 respectively get through the bracket 22, 25 and the resilient adjusting means connects the feeding shafts 9, 11 outside the feeding space. In an alternative embodiment, the resilient adjusting means can connect the two feeding shafts 9, 11 inside the feeding space.

The second feeding gear 8 of the feeding gear set turns the active feeding roller 7 to rotate, so that when the pencil is tightly sandwiched between the two feeding rollers 7, 12 under control of the resilient adjusting means, friction deriving from rotating of the active feeding roller 7 and restoring force of the resilient adjusting means will feed the pencil toward the cutter subassembly, and at the same time make the follower feeding roller 11 rotate there along. In detail, in the present embodiment, the second feeding gear 8 is mounted on the feeding shaft 9. So, the feeding shaft 9 is an active feeding shaft and another feeding shaft 11 is a follower feeding shaft. The feeding roller 7 is an active feeding one and another feeding roller 12 is a follower feeding roller.

Figure 6:
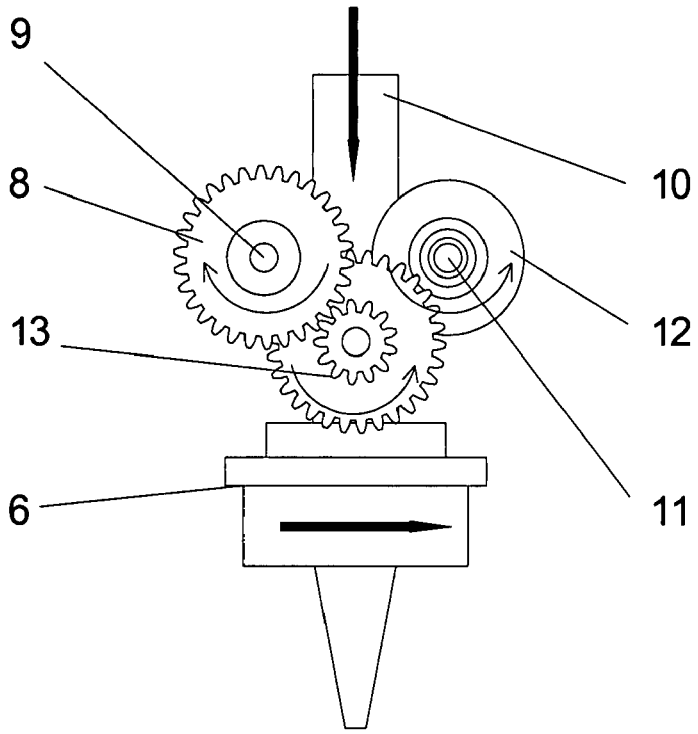
FIG. 6 is a perspective view of the feeding subassembly showing the working principle to feed a pencil.

Referring to FIG. 6, arrows indicate rotating directions when feeding the pencil 10, when retreating the pencil, gears will rotate in a counter direction. For sharpening pencils with different diameters purpose, interval between the two feeding shafts 9, 11 is adjustable, that is the interval between the two feeding rollers 7, 12 is kept changing in accordance with pencil diameter, so that engendering a predetermined friction force to carry the pencil 10. On condition that the pencil is nipped between the two feeding rollers 7, 12 too tight or too loose, the pencil 10 will be jammed and no longer goes into the cutter subassembly.

In present embodiment, the resilient adjusting means is an adjusting spring. In on embodiment, one resilient adjusting means is adopted, connecting the two feeding shaft 9, 11 outside or inside the feeding space. In an alternative embodiment, two resilient adjusting means, i.e., a first adjusting spring 23 and a second adjusting spring 24 are adopted, respectively connecting the two feeding shaft 9, 11 on two sides thereof outside or inside the feeding space. For specific illustrative purpose, the present invention incorporates a first adjusting spring 23 and a second adjusting spring 24.

Referring from FIG. I to FIG. 5 again, in order to adjusting the interval between the two feeding rollers 7, 12, the feeding rollers 7, 12 must be movablely supported on the bracket 22, 25 in corresponding slide ways 222. The pair of symmetric slide ways 222 together defines an arc-shaped locomotive track for the feeding rollers 7, 12 meanwhile keeping the second feeding gear 8 on the active feeding shaft 9 meshing with the cluster gear 13. On condition that both the feeding rollers 7, 12 goes upwards, the feeding rollers 7, 12 approach each other under restriction of the slide ways 222, therefore the distance between the first and second feeding rollers 7, 12 is reduced, and the pencils with small diameter can be sharpened. While both the feeding rollers 7, 12 goes downwards, the feeding rollers 7, 12 depart from each other and under restriction of the slide ways 222, therefore the distance between the two feeding rollers 7, 12 increases, and pencils with large diameter can be sharpened.

when the pencil 10 is inserted between the two feeding rollers 7, 12, the first adjusting spring 23 and the second adjusting spring 24 are stretched, the restoring force deriving from the stretched first and second adjusting springs 23, 24 will squeeze the pencil 10 by the first and second feeding rollers 7, 12, therefore the friction force between pencil 10 and feeding rollers 7, 12 drives the pencil 10 towards the cutter subassembly. On the merit of the adjusting spring 23, 24, people no longer need to manually operating the adjusting means. The adjusting process is automatically accomplished by the resilient adjusting means.

Referring to FIG. 5, the electric pencil sharpener further include an electric control system. The electric control system includes a startup switch 28, a triggering means and a reverse switch 27 under control of the triggering means for driving the motor 1 to rotate in a reverse direction. The reverse switch 27 is mounted on a switch support 26 in the cage 19. In the present embodiment, the triggering means includes a triggering block 30 arranged in the cutter subassembly, and a ganging rod 29 pushed by the triggering block 30. The ganging rod 29 makes the reverse switch 27 turn over the motor 1.

As the pencil 10 is inserted between the two feeding rollers 7, 12, the startup switch 28 of the electric control system is triggered and then the motor 1 rotate in a feeding direction. The transmission subassembly transmit the torsion from the motor to the feeding gear set and thereby the rotating feeding rollers 7, 12 carrying the pencil 10 into the cutter subassembly. The blade 14 spins around the blade shaft 31, and sharpens the feeding pencil 10. After the pencil 10 is processed, the end point of the pencil 10 touches the triggering block 30. The triggering block 30 pushes the ganging rod 29. Then the ganging rod 29 makes the reverse switch 27 to turn over the motor 1 to rotate in a retreating direction, which is a reverse direction relating to the feeding one, therefore, the pencil 10 is automatically feed and automatically retreated from the sharpener after the pencil is processed. The motor 1 is configured to rotate in a retreating direction for a predetermined period of time, and then the whole sharpening process is done.

Having thus described particular embodiment of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. An electric pencil sharpener comprising:

a motor;

a transmission subassembly driven by the motor;

a feeding subassembly comprising a feeding gear set comprising a crown gear operatively coupled to the transmission subassembly; a cluster gear operatively coupled to the crown gear; and a feeding gear operatively couple to the cluster gear and supported by a first feeding shaft; and a first feeding roller and a second feeding roller adapted to sandwich a pencil to be sharpened, wherein the feeding gear and at least the first feeding roller are supported by the first feeding shaft and the second feeding roller is supported by a second feeding shaft;

a pair of brackets arranged in parallel to each other and defining a feeding space therebetween for insertion of the pencil to be sharpened, wherein each of the brackets comprises a pair of hollow, symmetric and arc-shaped locomotive slide tracks; and wherein the first feeding roller and the second feeding roller are movably mounted on the pair of brackets through the first feeding shaft and the second feeding shaft, respectively, inserted into said slide tracks;

at least one resilient adjusting means connected to an end of the first feeding shaft with an end of the second feeding shaft, located either outside or inside the feeding space, and adapted to keep the feeding rollers nipping the pencil and engendering a pencil feeding friction, wherein said at least one resilient adjusting means is a spring connecting the first feeding shaft and the second feeding shaft that are mounted on the same bracket; and a cutter subassembly operatively driven by the transmission subassembly and connected with the feeding subassembly, wherein the cutter subassembly corresponds to the feeding space, so that the pencil to be sharpened can be inserted through the feeding space and then reach the cutter subassembly.

2. The electric pencil sharpener as in claim 1, wherein one resilient adjusting means is adopted, connecting the two feeding shafts outside or inside the feeding space.

3. The electric pencil sharpener as in claim 1, wherein two resilient adjusting means are adopted, respectively connecting the two feeding shafts on two sides thereof outside or inside the feeding space.

4. The electric pencil sharpener as in claim 1, wherein the cutter subassembly comprises a blade holder engaged with the transmission subassembly, and a blade.

5. The electric pencil sharpener as in claim 4, wherein the transmission subassembly comprises a gear train engaged with the motor, and a transmission shaft coupled with the gear train, and the transmission shaft is engaged with the blade holder.

6. The electric pencil sharpener as in claim 1, wherein the transmission subassembly comprises a gear train engaged with the motor, and a transmission shaft coupled with the gear train.

7. The electric pencil sharpener as in claim 1, further comprising an electric control system, the electric control system comprising a startup switch, triggering means, and reverse switch under control of the triggering means for driving the motor to rotate in a reverse direction.

8. The electric pencil sharpener as in claim 7, wherein the triggering means is provided with a triggering block arranged in the cutter subassembly, and a ganging rod pushed by the triggering block, the ganging rod makes the reverse switch turn over the motor.

* * * * *